US007913964B1

(12) United States Patent
Kennedy

(10) Patent No.: US 7,913,964 B1
(45) Date of Patent: Mar. 29, 2011

(54) PAINTING PAIL SYSTEM

(76) Inventor: Samuel Kennedy, Alliston (CA)

( * ) Notice: Subject to any disclaimer, the term of this patent is extended or adjusted under 35 U.S.C. 154(b) by 0 days.

(21) Appl. No.: 12/591,002

(22) Filed: Nov. 4, 2009

(51) Int. Cl.
*E06C 7/14* (2006.01)

(52) U.S. Cl. ..... 248/211; 248/210

(58) Field of Classification Search ..... 248/210, 248/211, 215, 146, 153, 311.2; 220/696, 220/697, 699, 758, 760, 772; 182/129, 121, 182/206

See application file for complete search history.

(56) References Cited

U.S. PATENT DOCUMENTS

| | | | | |
|---|---|---|---|---|
| 1,545,740 | A | 7/1925 | Cowell | |
| 2,444,986 | A | 7/1948 | Gebhardt | |
| 2,519,732 | A | 8/1950 | Bartolat | |
| 2,541,390 | A | 2/1951 | Weigand | |
| 2,557,694 | A | 6/1951 | Sagen | |
| 2,674,427 | A | 4/1954 | Woodward et al. | |
| 2,907,541 | A | 10/1959 | Haislip | |
| 3,061,140 | A * | 10/1962 | Barnes | 220/699 |
| 3,094,304 | A | 6/1963 | Linder, Jr. | |
| 3,291,337 | A * | 12/1966 | Jenkins | 220/697 |
| 3,420,486 | A | 1/1969 | Baker | |
| 4,266,746 | A | 5/1981 | Klaiber | |
| 4,899,970 | A * | 2/1990 | Berzina | 248/210 |
| 5,716,034 | A | 2/1998 | Unkefer | |
| 5,826,844 | A | 10/1998 | Purdy | |
| 6,783,103 | B2 * | 8/2004 | Salani | 248/211 |

* cited by examiner

*Primary Examiner* — Gwendolyn Baxter
(74) *Attorney, Agent, or Firm* — Antony C. Edwards

(57) ABSTRACT

A painting pail system includes a bucket, a bucket support, and a brace for the support. The bucket has an open top. The open top has a rod mounted thereacross. The support may be a U-shaped support having a pair of arms extending from a base, where the base is mounted to the substantially vertical brace so as to extend the arms substantially horizontally from the brace. The rod is mounted at its ends to distal ends of the arms, that is, distal from the base. The upper end of the brace includes a pair of mounting hooks spaced apart laterally so as to hook over an upper rung. The brace is elongate and its lower end is adapted to engage against a lower rung. A selectively engageable third hook latches the pair of mounting hooks onto the upper rung. The bucket may be removed from the support by releasing a latch arm mounted on the support.

15 Claims, 3 Drawing Sheets

PAINTING PAIL SYSTEM

FIELD OF THE INVENTION

This invention relates to the field of devices for suspending paint containers from ladders and the like for the ease of use of a painter.

BACKGROUND OF THE INVENTION

One aspect of the painting pail system according to the present invention is to provide a stable mounting system to securely mount a paint bucket to a vertically spaced apart pair of rungs, for example on a ladder, so that the bucket, when heavy due to it carrying a paint load, remains stably supported and stably mounted to the rungs until the painter desires to re-fill the bucket or remove the entire pail system from the rungs. The present invention provides for ease of removing of the bucket from its suspension on its supports and for ease of re-securing the bucket back on its supports. The present invention also provides for ease of securing a bracing frame on which the bucket supports are mounted onto the rungs while also providing an easily releasable latching arrangement to provide for ease of removal of the bracing frame from the rungs.

In the prior art, applicant is aware of the following United States patents directed to devices which have attempted to address the problem of temporarily suspending a paint bucket from a ladder or the like:

U.S. Pat. No. 1,545,740 which issued Jul. 14, 1925, to Cowell for a Pot and Bucket Holder, provides an arm having a hook at one end for hooking over a ladder rung, and spur at its opposite end for suspending a pot by its bail.

U.S. Pat. No. 2,444,986, which issued Jul. 13, 1948, to Gebhardt for a Holder for Paint Buckets and the Like, discloses a hook for engaging a rung of a ladder where lower portion of the hook is twisted to extend flatly along the inside of a rail of the ladder. A U-shaped member is attached at one side of the lower portion of the hook. The U-shape member straddles the rail. A bar having a hook is mounted to the U-shape member. The hook engages the bail of a bucket.

U.S. Pat. No. 2,519,732 which issued Aug. 22, 1950, to Bartolat for a Bucket Holder, provides a hanger plate having a hook to engage the bail of a bucket. Another plate is slidably mounted on the hanger plate so that the plate may be slid to engage the bail in the hook. A hanger hook mounted above the hanger plate suspends the hanger plate from a rung or other object.

U.S. Pat. No. 2,541,390 which issued Feb. 13, 1951, to Weigand for a Receptacle Holder, provides for supporting a paint can upon a rung and rail of a ladder by the use of a heavy wire bent intermediate its ends to provide a horizontal handle. An upright brace depends from the handle. A socket member embraces a side rail of the ladder. A rest on the socket member engages a rung. A stabilizer on the brace embraces the side wall of the paint can. A hanger on the upright brace hooks the annular interior channel around the rim of the paint can.

U.S. Pat. No. 2,557,694 which issued Jun. 19, 1951, to Sagen for a Paint Bucket and Brush Holder, discloses a bar which engages the periphery of a bucket or pail vertically and clamps thereon. The bar extends upwardly and has bent portions forming open loops to engage the rung of a ladder.

U.S. Pat. No. 2,674,427 which issued Apr. 6, 1954, to Woodward et al. for a Paint Can Support for Ladders, discloses a hanger wherein each leg of the hanger has a downwardly opening slot for hooking over the rung of a ladder. A re-entrant tongue locks behind and beneath the rung.

U.S. Pat. No. 2,907,541, which issued Oct. 6, 1959, to Haislip for a Paint Pail and Brush Holder Attachment for Step Ladders, teaches a foldable support member in the form of an auxiliary extension type rail hingedly mounted on the upper portion of one of the rails of the ladder. Holders are slidably mounted on the extension rail. The extension rail is swung up to its useful position and pinned into place, or swung down into an out-of-the-way folded position. The hangers have hooks for engaging the bail or handle of a bucket or pail.

U.S. Pat. No. 3,094,304, which issued Jun. 18, 1963, to Linder for a Ladder Bracket with Paint Bucket Holder, teaches an elongated j-shaped bolt having a hook at its lower end to releasably engage over the bead on a paint bucket. An arm or limb is mounted to the bolt and has a hook at its upper end for engaging over the rung of a ladder.

U.S. Pat. No. 3,420,486, which issued Jan. 7, 1969, to Baker for a Ladder Bracket, discloses a horizontal arm cantilevered to either side of a ladder, and supported on the ladder by engagement of the arm with both a rung and a rail of the ladder. A ring is mounted on the arm to hold a bucket. The ring swivels to keep the bucket vertical.

U.S. Pat. No. 4,266,746, which issued May 12, 1981, to Klaiber for a Paint Brush, Pad and Roller Holder and Can Carrier, discloses an inclined support having a transverse shelf projecting from the lower end. The support is hooked onto a rung of the ladder.

U.S. Pat. No. 5,716,034, which issued Feb. 10, 1998, to Unkefer for an Apparatus for Hanging a Bucket on a Ladder, teaches a hanger for suspending paint bucket from the rung of a ladder wherein the hanger has a hook at its upper end to suspend the hanger from the rung. A lower, upwardly turned hook is also provided from which the handle of a bucket is suspended. A support below the upwardly turned hook supports the side of the paint bucket.

U.S. Pat. No. 5,826,844 which issued Oct. 27, 1998, to Purdy for Bucket Brackets, discloses a U-shaped bracket shape to hold onto a rail of a ladder. A band may be attached to the bracket. The band may be adjustable in circumference.

SUMMARY OF THE INVENTION

In summary the painting pail system according to the present invention may be characterized in one aspect as including a bucket, a bucket support, and a brace for the support. The bucket has an open top. The open top has a rod mounted thereacross. The support may be a U-shaped support having a pair of arms extending from a base, where the base is mounted to the substantially vertical brace so as to extend the arms substantially horizontally from the brace. The rod is mounted at its ends to distal ends of the arms, that is, distal from the base. The upper end of the brace includes a pair of mounting hooks spaced apart laterally so as to hook over an upper rung. The brace is elongate and its lower end is adapted to engage against a lower rung.

A third hook is mounted adjacent the pair of mounting hooks. The third hook is movable relative the pair of mounting hooks so as to be selectively engageable and dis-engageable against the upper rung when the pair of mounting hooks are engaged over the upper rung. The third hook is movable so as to be oppositely disposed relative to the pair of hooks when the third hook and the pair of hooks are engaged over the upper rung. In a preferred embodiment the pair of mounting hooks curve away from the bucket and the base of the support. In that embodiment, the third hook is curved towards the bucket and the base of the support when in its rung-engaging position mountable over the upper rung, and is curved away from the bucket when in a dis-engaged position moved away from the upper rung.

Advantageously the third hook is mounted atop a substantially vertical shaft. The shaft may be mounted to the base of the support for rotation and sliding translation relative thereto so as to move the third hook firstly between its rung-engaging position and its dis-engaged position, and, secondly, between its dis-engaged position and a lowered position. When its dis-engaged position, the third hook is first elevated relative to the pair of hooks, and then rotated on the shaft relative the base of the support so as to be selectively rotated away from the upper rung when the pair of hooks are mounted over the upper rung. The third hook and shaft may then be lowered to the lowered position below the pair of hooks to allow the pair of hooks to be removed from the upper rung.

A spring may be mounted on the shaft, on a lower end thereof, to resiliently bias the shaft downwardly by the engagement of the top of the spring against a mounting post extending from the base of the support. The shaft is substantially linear and the shaft may be slidably mounted to the post for vertical sliding relative thereto.

The brace may be a vertical U-shape and the support may be a horizontal U-shape extending orthogonally from the vertical U-shape of the brace. The vertical U-shape may have a substantially parallel pair of legs. The base of the support may be mounted to the pair of legs so as to allow for vertical adjustment of the position of the base along the legs of the brace. Selectively engageable position locks may be provided which cooperate with the pair of posts for selectively locking the position of the supports along the pair of legs of the brace.

A pair of posts may be mounted to the base, and the pair of legs may be journalled through a corresponding pair of bores formed in the pair of posts. The post supporting the third hook may be a center post mounted between the pair of posts. The spring engages against the center post as the third hook and the shaft are translated upwards so as to slide the shaft through a bore formed in the center post.

A selectively releasable latch may be mounted at one of the distal ends of the pair of arms. The latch selectively engages a corresponding end of the rod so as to selectively retain the bucket on the support.

A fourth hook may be mounted on, so as to extend outwardly of, one arm of the pair of arms. The fourth hook is adapted for hanging paint brushes therefrom.

DETAILED DESCRIPTION OF EMBODIMENTS OF THE INVENTION

Figure 1:
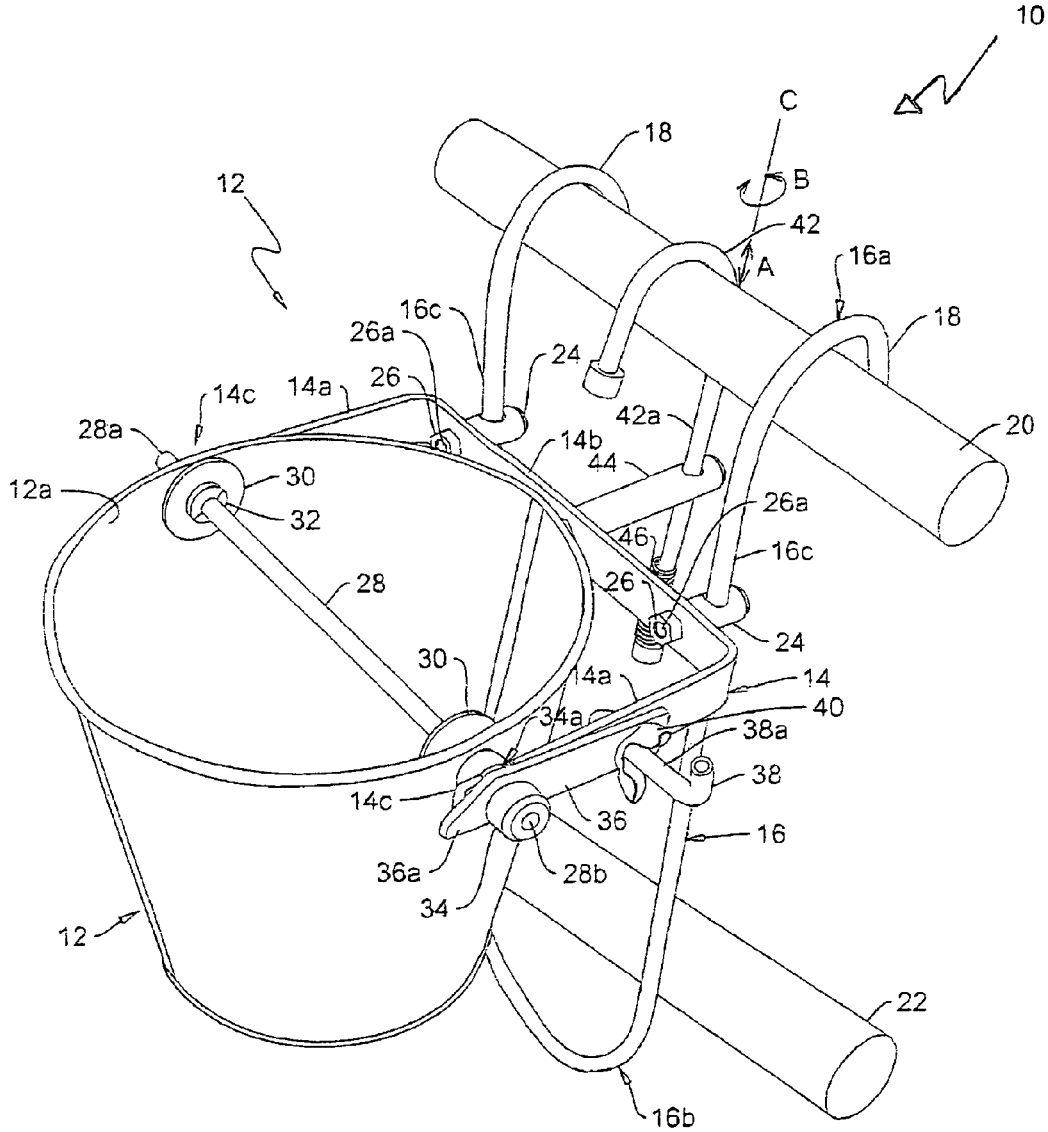
FIG. 1 is, in perspective view, the painting pail system according to the present invention.
Figure 2:
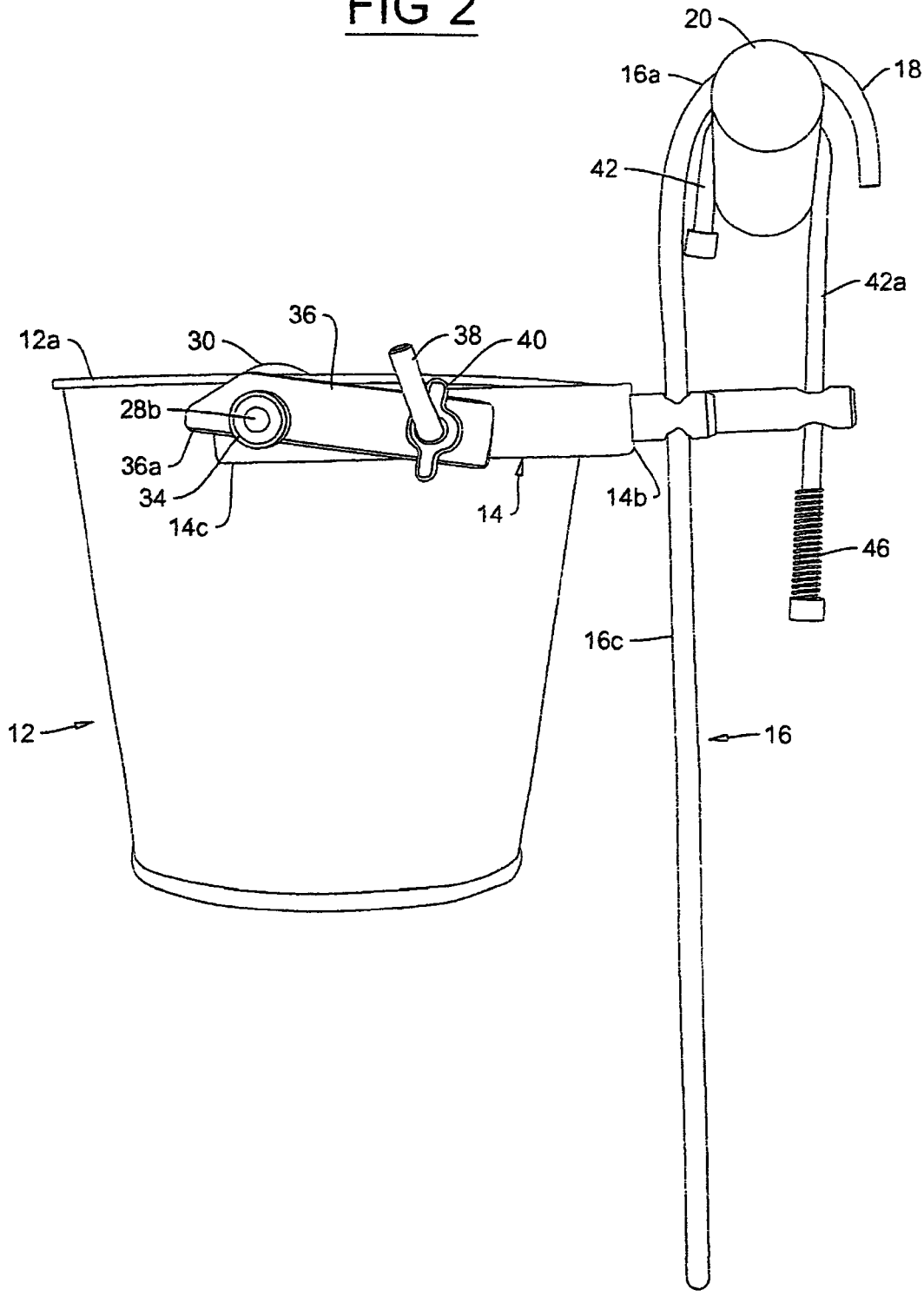
FIG. 2 is, in side elevation view, the painting pail system of FIG. 1.

As seen in the accompanying figures wherein like reference numerals denote corresponding parts in each view, the painting pail system 10 according to the present invention, includes a paint bucket 12, a support bracket 14, and a brace 16.

The upper end of brace 16 includes a laterally spaced apart pair of hooks 18 sized to somewhat snugly fit over the upper rung 20 of a pair of rungs 20 and 22. Brace 16 extends generally vertically when in use so that when the upper end 16*a* of the brace is engaged over upper rung 20, the lower end 16*b* of the brace is engaged against lower rung 22 so as to brace support bracket 14 in a generally horizontal orientation extending cantilevered orthogonally outwardly from the elongate portion 16*c* of brace 16 extending between its upper and lower ends 16*a* and 16*b* respectively. In particular, legs 16*c* extend generally parallel between the U-shaped bottom of the brace at lower end 16*b* and the pair of hooks 18 at the upper end 16*a* of the brace.

Support bracket 14 may also be substantially U-shaped, having a parallel pair of arms 14*a* extending outwardly from base 14*b* to distal ends 14*c*. Base 14*b* is rigidly mounted to brace 16 by a pair of posts 24. Posts 24 are mounted to, so as to extend away from, base 14*b*. Posts 24 have a corresponding pair of vertically opening bores or apertures formed therein, through which legs 16*c* are journalled. Threaded members 26*a* extend through corresponding apertures in base 14*b* into threaded engagement within corresponding threaded bores in posts 24 so as to engage the ends of members 26*a* in frictional engagement against legs 16*c* within the apertures in post 24. Members 26*a* may be loosened so that the position of support bracket 14 may be adjusted along the length brace 16. Once the desired position of bracket 14 along brace 16 is achieved, members 26*a* are tightened so as to engage against legs 16*c* thereby releasably locking the position of bracket 14 along brace 16. Threaded nuts 26 are threaded onto members 26*a* so as to snug nuts 26 against base 14*b* to thereby rigidly mount base 14*b* to posts 24.

A rigid member or rod 28 is mounted laterally across the open top of bucket 12 so as to extend the opposite ends 28*a* and 28*b* of rod 28 from and between corresponding apertures formed in the upper rim 12*a* of bucket 12. Rigid washers 30 are mounted onto the ends of rod 28 on resilient gaskets 32 and snugged against rim 12*a* so as to retain rod 28 in position relative to bucket 12. End 28*a* of rod 28 is mounted through an aperture formed in the corresponding distal end 14*c* of the corresponding arm 14*a* of bracket 14. The opposite end 28*b* of rod 28 rests in a notch formed in the corresponding distal end 14*c*. In particular, a bar-bell shaped lug 34 is mounted onto end 28*b* of rod 28, and the narrow waisted portion 34*a* of lug 34 mates into the notch in the distal end of 14*c*. A latch bar 36, which is pivotally mounted on the shank 38*a* of hook 38, hooks notch 36*b* down onto the waisted portion 34*a* of lug 34 closely along side the corresponding distal end 14*c*. Threaded wing-nut 40 is threadably mounted onto the threaded end of shank 38*a*. Wing-nut 40 may be loosened so that latch bar 36 may be elevated when it is desired to remove bucket 12 from bracket 14. Bucket 12 is removed by the raising of end 28*b* of rod 28 from the corresponding notch formed in distal end 14*c*. When it is desired to retain rod 28 in bracket 14, latch bar 36 is lowered so as to engage its notch 36*b* of end 36*a* down onto the waisted portion 34*a* of lug 34. Wing-nut 40 is then tightened along the threaded portion of shank 38*a* so as to lock latch bar 36 in place.

With bucket 12 so mounted to bracket 14, and with bracket 14 locked into position on brace 16, and with hooks 18 hooked over rung 20 and the lower end 16*b* of brace 16 engaged resting against rung 22, the center hook 42 may be engaged to latch the brace to rung 20 by hooking hook 42 over rung 20 in a direction reverse to hooks 18. This releasably locks brace 16 onto rung 20.

Figure 3:
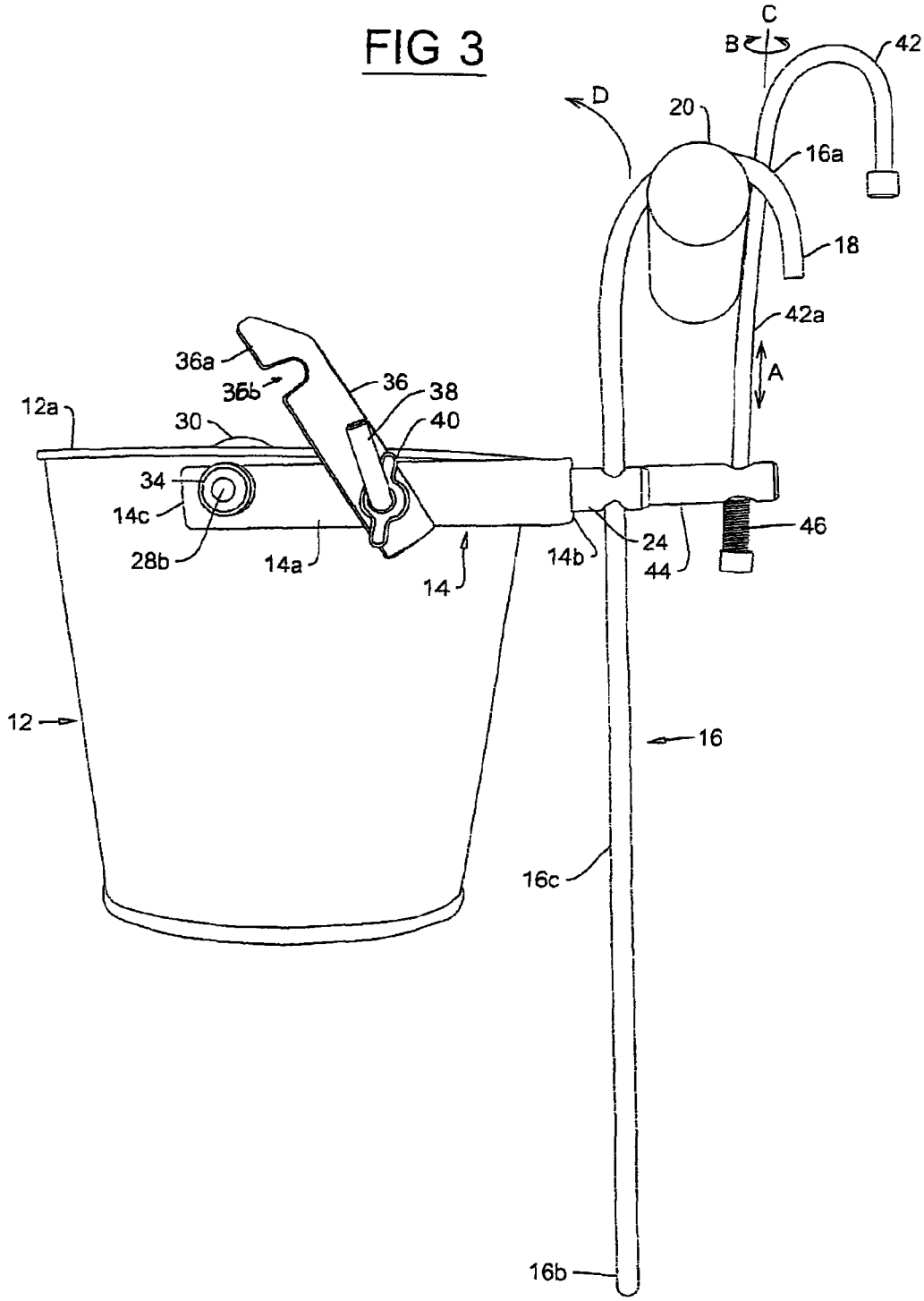
FIG. 3 is a side elevation view of the painting pail system of FIG. 2, with the bucket latch dis-engaged and with the rung latch dis-engaged.

Center hook 42 thus operates as a rung latch. The shank 42*a* of center hook 42 is journalled vertically through a corresponding vertically opening bore or aperture formed in the free end of post 44. The opposite end post 44 is bolted or otherwise rigidly mounted to the center of base 14*b*. With shank 42*a* slidably journalled in the bore in post 44, center hook 42 may be raised and lowered in direction A so that, as seen in FIG. 3, with the center hook 42 raised against the resilient return biasing force of the compression of spring 46, center hook 42 may be rotated in direction B about its axis of rotation C so as to rotate center hook 42 into an orientation reverse to the orientation of hooks 18, that is, into the rung engaging position of hook 42. Center hook 42 may also be rotated 180 degrees away from its rung engaging positions into its rung dis-engaging position. With center hook 42 in its rung dis-engaging position of FIG. 3, center hook 42 may be lowered in direction A relative to post 44. Center hook 42 is lowered below rung 20 sufficiently so as to allow hooks 18 to be raised relative to rung 20 and thereby unhooked and removed in direction D. This removes the painting pail system according to the present invention from the rungs.

In use, once the painting pail system according to the present invention has been installed onto rungs 20 and 22, paint for use by the painter may be stored within bucket 12 and a paint brush suspended from hook 38 until needed. Once the paint brush is in use, the painter dips the brush bristles into the paint within bucket 12 and as the brush is being removed from the bucket the bristles may be brushed against rod 28 so as to remove excess paint from the bristles.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A painting pail system comprising:

a bucket having an open top, said open top having a rod mounted thereacross, a U-shaped support having a pair of arms extending from a base, said base mounted to a substantially vertical brace so as to extend said arms substantially horizontally from said brace, said rod mounted at its ends to distal ends of said arms, distal from said base, said brace having a upper end and an opposite lower end, said upper end including a pair of mounting hooks spaced apart laterally so as to hook over an upper rung, said brace elongate between said upper and lower ends so as to be adapted to engage said lower end against a lower rung beneath the upper rung, further comprising a third hook mounted adjacent said pair of mounting hooks, said third hook movable relative to said pair of mounting hooks so as to selectively engagable and disengagable against the upper rung when said pair of mounting hooks are engaged over the upper rung.

2. The system of claim 1 wherein said third hook is oppositely disposed relative to said pair of hooks when said third hook and said pair of hooks are engaged over the upper rung.

3. The system of claim 1 wherein said pair of mounting hooks curve away from said bucket and said base of said support.

4. The system of claim 3 wherein said third hook is curved towards said bucket and said base of said support when in a rung-engaging position mountable over the upper rung, and is curved away from said bucket when in a dis-engaged position moved away from the upper rung.

5. The system of claim 4 wherein said third hook is mounted atop a substantially vertical shaft, and said shaft is mounted to said base of said support for sliding translation relative thereto so as to move said third hook between said rung-engaging position and said dis-engaged position.

6. The system of claim 5 wherein, when in said dis-engaged position, said third hook is elevated relative to said pair of hooks, and wherein said third hook and said shaft are rotatable relative to said base of said support so as to selectively rotate said third hook away from the upper rung when said pair of hooks are mounted over the upper rung.

7. The system of claim 6 further comprising a spring mounted on said shaft to resiliently bias said shaft downwardly.

8. The system of claim 7 wherein said shaft is substantially linear and wherein said base of said support further comprises a center post, and wherein said shaft is slidably mounted to said post.

9. The system of claim 8 wherein said brace is a vertical U-shape and said support is a horizontal U-shape extending orthogonally from said vertical U-shape.

10. The system of claim 9 wherein said vertical U-shape has a substantially parallel pair of legs and wherein said base of said support is mounted to said pair of legs for vertical adjustment of a position of said base therealong.

11. The system of claim 10 further comprising a pair of posts mounted to said base, wherein said pair of legs are journalled through a corresponding pair of bores formed in said pair of posts.

12. The system of claim 11 wherein said center post is mounted between said pair of posts, and wherein said spring engages against said center post as said third hook and said shaft are translated upwards so as to slide said shaft through a bore formed in said center post.

13. The system of claim 12 further comprising a fourth hook mounted on, so as to extend outwardly of, one arm of said pair of arms, wherein said fourth hook is adapted for hanging paint brushes therefrom.

14. The system of claim 12 further comprising selectively engagable position locks cooperating with said pair of posts for selectively locking the position of said supports along said pair of legs of said brace.

15. The system of claim 1 further comprising a selectively releasable latch mounted at one of said distal ends of said pair of arms, said latch selectively engaging a corresponding end of said rod so as to selectively retain said bucket on said support.

* * * * *